United States Patent [19]

Pittasch et al.

[11] 4,159,557

[45] Jul. 3, 1979

[54] CABINET HINGE

[75] Inventors: Willi Pittasch; Johannes Dalbert, both of Herford, Fed. Rep. of Germany

[73] Assignee: Firma Richard Heinze, Westfalen, Fed. Rep. of Germany

[21] Appl. No.: 844,118

[22] Filed: Oct. 20, 1977

[30] Foreign Application Priority Data

Oct. 22, 1976 [DE] Fed. Rep. of Germany ..... 2647776
Oct. 23, 1976 [DE] Fed. Rep. of Germany ..... 2648095

[51] Int. Cl.[2] ..... E05D 5/02; E05D 7/04
[52] U.S. Cl. ..... 16/129; 16/130
[58] Field of Search ..... 16/129–134, 16/137, 149, 171

[56] References Cited

U.S. PATENT DOCUMENTS 3,965,532 6/1976 Wigfall ..... 16/149

FOREIGN PATENT DOCUMENTS 2124695 12/1972 Fed. Rep. of Germany ..... 16/130
2454923 8/1976 Fed. Rep. of Germany ..... 16/137
2554129 6/1977 Fed. Rep. of Germany ..... 16/129
2554133 6/1977 Fed. Rep. of Germany ..... 16/129
3136 of 1909 United Kingdom ..... 16/130

*Primary Examiner*—James Kee Chi
*Attorney, Agent, or Firm*—Jacobs & Jacobs

[57] ABSTRACT

Cabinet hinge for the articulated connecting of two cabinet parts, and particularly for pivoting a cabinet door to a cabinet body, having a first hinge which is adapted to be fastened in a recess of the first cabinet part and having a second hinge part which is adapted to be fastened to the second cabinet part, to which second hinge part a preferably tang-shaped hinge arm is pivoted, characterized by the fact that the first mentioned hinge part consists of an outer anchoring part and of an inner part arranged in a first opening of said anchoring part, said inner part being adjustable along a first axis extending perpendicular to the surface of the first cabinet part; that a guide, preferably a second opening, is provided on the inner part to receive the hinge arm; and that means are provided to fasten the hinge arm in continuously adjustable manner to the first hinge part.

21 Claims, 19 Drawing Figures

Fig. 4
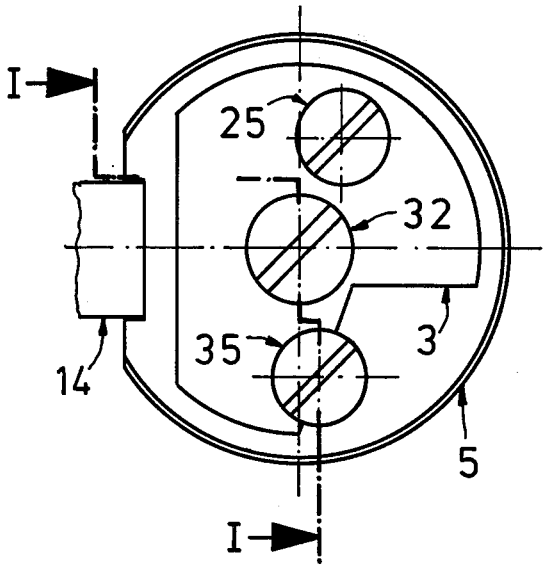
Fig. 5 (I-I)
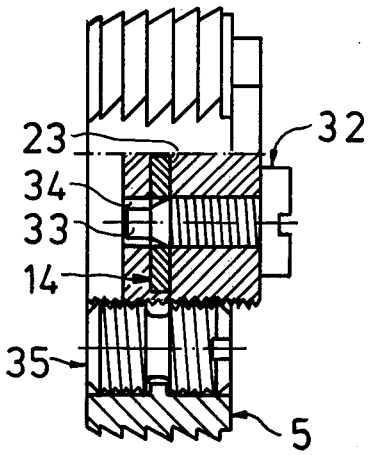
Fig. 6
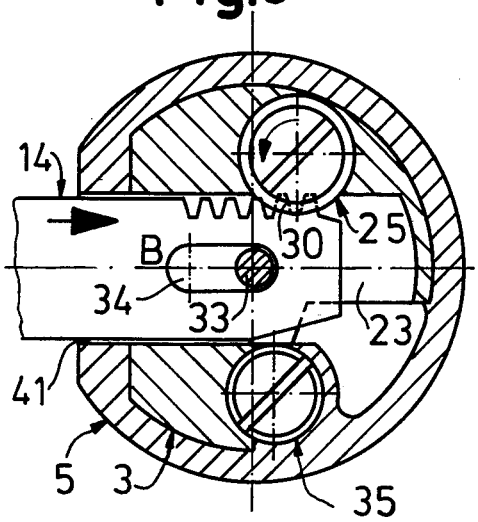
Fig. 7
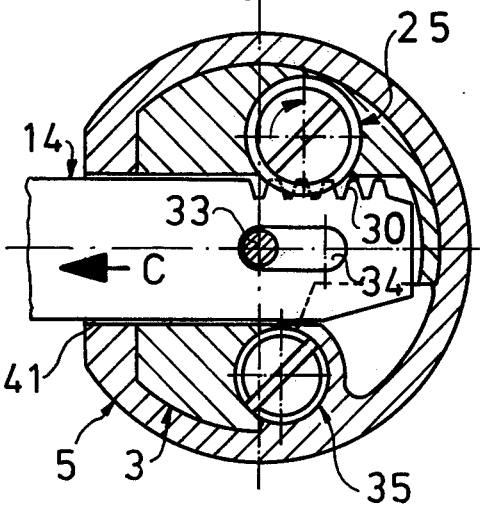

Fig. 9
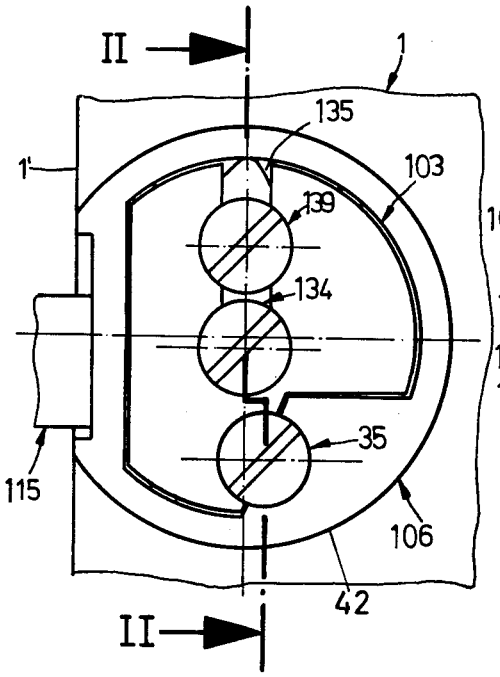
Fig. 10
(II–II)
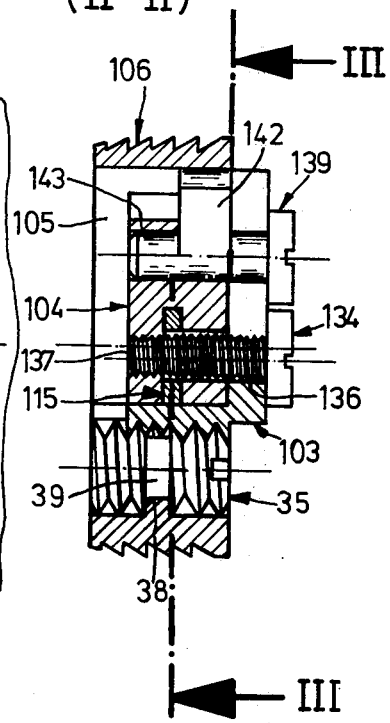
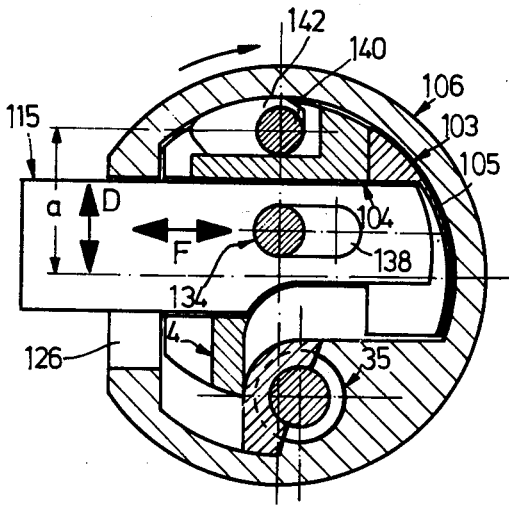
Fig. 11
(III-III)
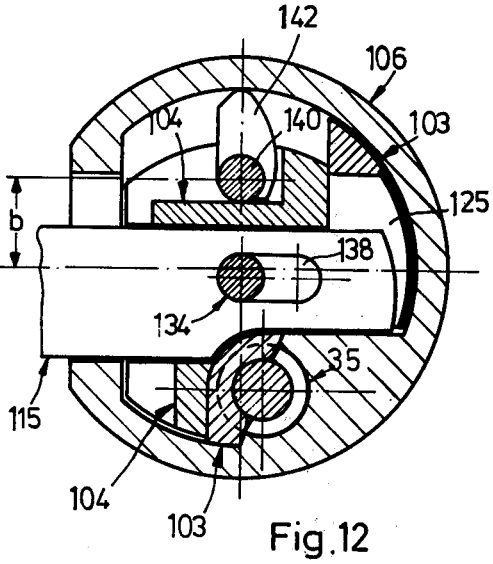
Fig. 12
(II-II)

(IV-IV)

( V- V)

( V- V)

CABINET HINGE

The present invention relates to a cabinet hinge for the articulated connection of two cabinet parts, and particularly for pivoting a cabinet door to a cabinet body having a first hinge part which is adapted to be fastened in a recess in the first cabinet part and having a second hinge part which is adapted to be fastened to the second cabinet part and to which a hinge arm of preferably tang-shape or partial tang-shape is pivoted.

Hinges are already known which consist of a first hinge part which is adapted to be fastened to a first cabinet part (for instance, to the side wall of a cabinet) and of a second hinge part which is adapted to be fastened to a second cabinet part (for instance, to a cabinet door) has at least one support for a hinge pin and a pivoted arm or tang which can be locked on the first hinge part. These known hinges however are relatively expensive to manufacture and are not suitable for streamlined cabinet manufacture, particularly if the machines or equipment at present used in the furniture industry are to be employed.

The object of the invention is to improve a cabinet hinge of the aforementioned type in such a manner that the simple mounting of the hinge parts on the cabinet parts is possible and at the same time a simple anchoring of the hinge arm in the first hinge part can be obtained. Another object of the invention is to improve a cabinet hinge of the aforementioned type in such a manner as to make possible a displacement of the hinge arm which is as continuous as possible relative to the first cabinet part, for example relative to the cabinet body.

In order to achieve this purpose, a cabinet hinge of the aforementioned type is so developed in accordance with the invention that the first hinge part consists of an outer anchoring part and of an inner part which is arranged in a first opening of said anchoring part and is adjustable along a first axis in space which extends perpendicular to the surface of the first cabinet part; that a guide, preferably a second opening, to receive the hinge arm is provided on the inner part; and that means are provided to fasten the hinge arm in continuously adjustable fashion to the first hinge part.

The continuous displacement of the hinge arm by means of the guide provided in the inner part of the first hinge part is effected preferably in the longitudinal direction of the hinge arm so that the hinge arm can be adjusted along two axes in space, namely in the direction perpendicular to the surface of the first cabinet part, i.e. for instance perpendicular to the inner surface of a cabinet side-wall by means of the inner part which is arranged adjustably in the outer anchoring part, and in a direction parallel to the surface of the first cabinet part by means of the said guide.

The continuous adjustment of the hinge arm in the guide is preferably effected in the manner that at least one toothing, for instance a toothing which extends in the longitudinal direction of the hinge arm is provided on the hinge arm and engages with a first adjustment member arranged in the first hinge part, for instance in the inner part of said first hinge part, namely for example with a gear or pinion which is rotatably supported in the first hinge part.

In this connection, the adjustment member is rotatable around an axis which extends parallel to the first axis in space, the adjustment member being accessible from the outside for a tool after the first hinge part has been inserted in the recess of the first cabinet part.

In accordance with a further development, the hinge arm in the first hinge part is adjustable in the direction of the hinge pin or pins, so that an adjustment of the hinge arm is possible in three directions in space, i.e. perpendicular to the surface of the first cabinet part, parallel to the surface of the first cabinet part, and at the same time perpendicular to the axis of swing of the hinge, and in the direction parallel to the surface of the first cabinet part and in the direction of the axes of swing of the hinge. In this embodiment, the inner part of the first hinge part preferably consists of a base body and of a slide which then is adjustable relative to the base body in the direction of the third axis in space, i.e. in the direction of the axis of swing of the hinge.

By means of the invention there is created a rapidly-mounted hinge which is of simple construction, can be worked with the equipment already existing at the furniture manufacturer's, which furthermore permits the technically unskilled final consumer to effect a rapid and reliable assembling of the cabinet parts (pivoting of the cabinet door to the cabinet body), and which furthermore makes possible in just as simple as reliable a manner the adjusting of the cabinet door in the said axes in space. In the same manner, the hinge of the invention permits a simple and uncomplicated removal (for instance, upon moving) of a cabinet door from a cabinet body. The hinge is functionally and aesthetically attractive in appearance, protruding and visible parts being avoided to the greatest extent possible. The hinge of the invention operates without disturbance or maintenance, even in case of heavy duty over a long period of time.

The hinge of the invention can be used in the same manner for the pivoting or flush or rabbetted cabinet doors at least a part of the thickness of which, upon closing, swings into an opening defined by the side walls of the cabinet, the bottom of the cabinet, and the top of the cabinet, and for outside-lying cabinet doors which, when closed, rest against the face surfaces of a cabinet in the vicinity of the door opening. Furthermore, it is possible with the hinge of the invention for the cabinet manufacturer to premount the hinge parts on the cabinet side wall and on the cabinet door respectively, so that the cabinet can be delivered in broken-down condition by the cabinet manufacturer to the final consumer so as to reduce shipment space and the cabinet door be mounted at the final consumer's even by untrained personnel by merely fastening the hinge arm to the first hinge part. Furthermore, the hinge of the invention provides assurance that at least the hinge parts which are already premounted by the cabinet manufacturer on the first cabinet part, for instance on the cabinet side wall, cannot protrude in disturbing fashion beyond the surface of the body of the cabinet, so that damage to the cabinet parts by protruding hinge parts during transportation is avoided.

Further developments of the invention are described in the subordinate claims.

The invention will be explained in further detail below with reference to illustrative embodiments shown in the drawing, in which:

FIGS. 4 and 5 are a top view of the first hinge part and a section along the line I—I respectively;

FIGS. 6 and 7 show the first hinge part in cross section and in different positions of the hinge arm in the recess or second opening of said hinge part;

FIGS. 9 and 10 are a top view of the first hinge arm anchored in a cabinet side wall and a section along the line II—II respectively;

FIGS. 11 and 12 are a section along the line III—III of FIG. 10 with different positions of the hinge arm along an axis in space which extends parallel to the axis of swing of the hinge;

Figure 1:
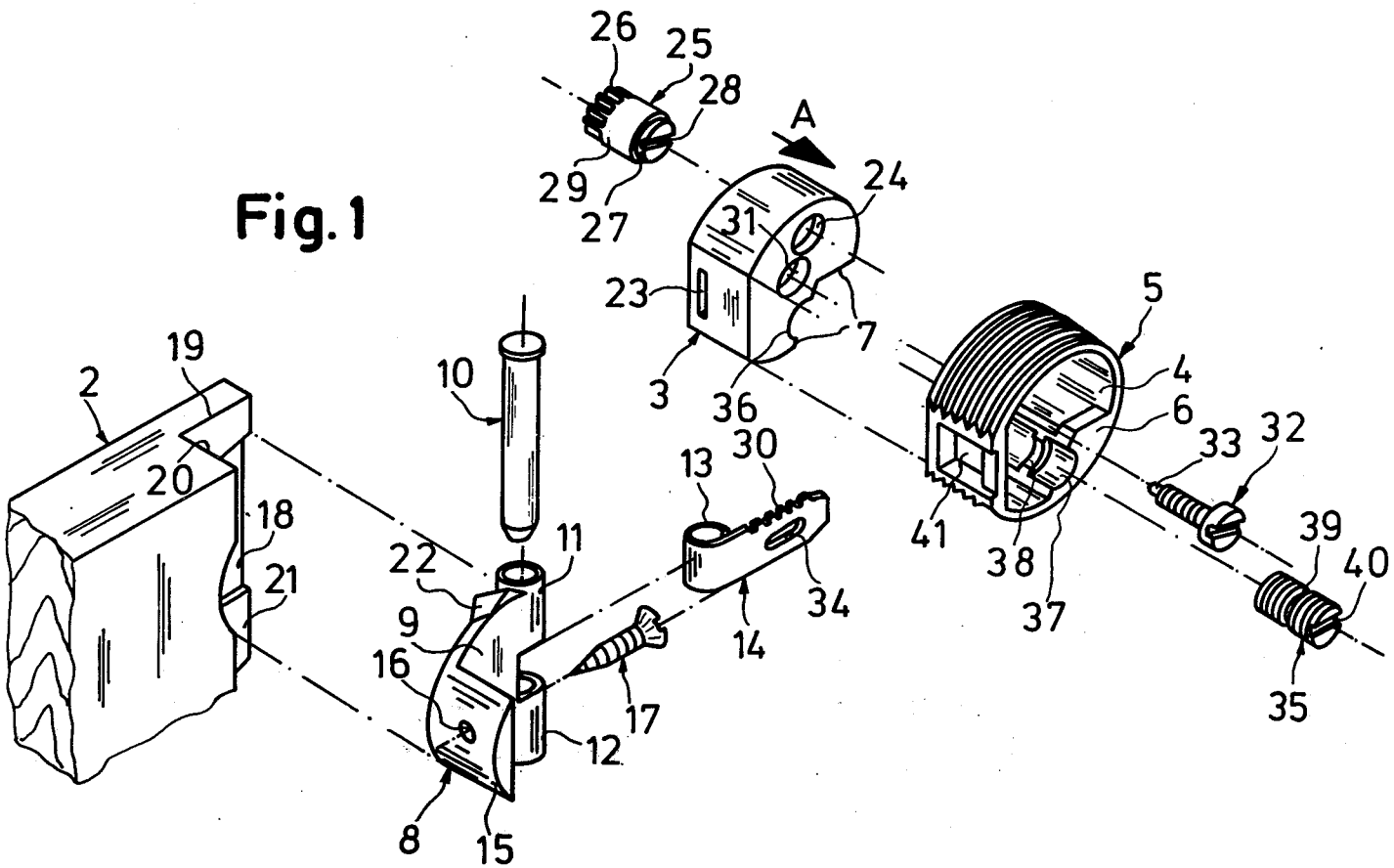
FIG. 1 shows, in exploded perspective view, one embodiment of the hinge of the invention with the hinge parts separated from each other, together with a partial view of the cabinet door.
Figure 3:
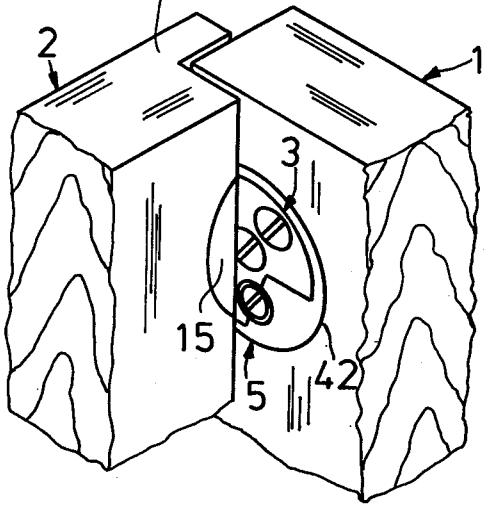
FIG. 3 is a perspective view of the cabinet body and the closed cabinet door, with the hinge arm already inserted into the recess or second opening of the first hinge part.

In FIGS. 1 to 7, 1 is a cabinet body or cabinet side wall and 2 is a rabbetted cabinet door which is pivoted to the cabinet body 1 by the hinge in accordance with the invention. The hinge, in the embodiment shown in FIGS. 1 to 7, consists of an adjustment-body or slide 3 which forms the inner part of the first hinge part and is held for adjustment or displacement, in a recess or first opening of a substantially sleeve-shaped intermediate body 5 or anchoring part of the first hinge part in the direction perpendicular to the surface of the cabinet body 1 or or the axial direction of the anchoring part 5.

In the case of the embodiment shown in the drawing, the adjustment body 3 has a partially circular (three-quarter-circular) or circular-segment shaped cross section, the opening 4 of the anchoring part 5 being adapted to said cross section and engaging by means of a shoulder 6 of circular-segment shape which protrudes into the opening 4, into the recess 7 of circular-segment shape of the adjustment body 3. In this way assurance is had that the adjustment body 3 while it can be displaced perpendicular to the surface of the cabinet part 1 cannot however turn relative to the anchoring part 5.

The hinge shown in FIGS. 1 to 7 consists furthermore of a second hinge part 8 which is formed essentially of a plate 9 of partially circular or semi-circular shape which is provided with knuckles 11 and 12 formed on the side facing away from the circular surface and serving to support the sole hinge pin 10, the knuckles being such a distance from each other that they can receive between them the end 13, rolled together to form a hinge knuckle, of a tang-shaped hinge arm 14 which is then pivoted by the hinge pin 10 to the hinge part 8. For fastening to the cabinet door 2 there is furthermore provided on the plate 9 on the side opposite the knuckles 11 and 12 a wall section 15 which extends perpendicular to the surface sides of the plate 9 and has a bore 16 for a fastening screw 17. The arranging or fastening of the hinge part 8 on the cabinet door is effected in a recess 18 which is open towards the front side and is provided in part, also in the rabbet 19 of the cabinet door and continues in the rest of the cabinet door. The hinge part 8 is pushed laterally into the recess 18 in such a manner that the plate 9 comes to lie in the part of the recess 18 within the edge 19 while the wall section 15 is arranged in the continuation of the recess 18 on the inner edge 20 of the rabbet and is held fast by screwing the fastening screw 17 into the material of the cabinet door.

Figure 2:
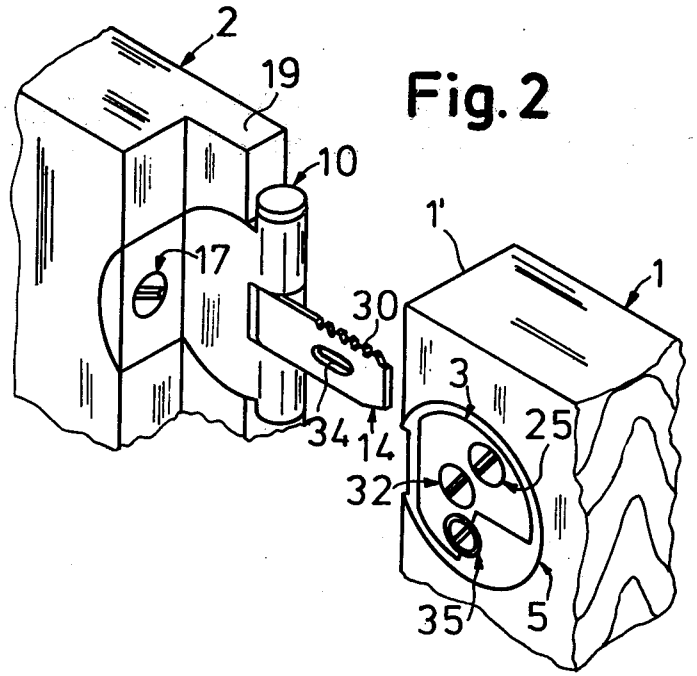
FIG. 2 shows, in perspective, the hinge of FIG. 1 together with a partial showing of the body of the cabinet and of the cabinet door before the hinge arm has been introduced into the recess in the hinge part which has been fastened to the cabinet body.
Figure 8:
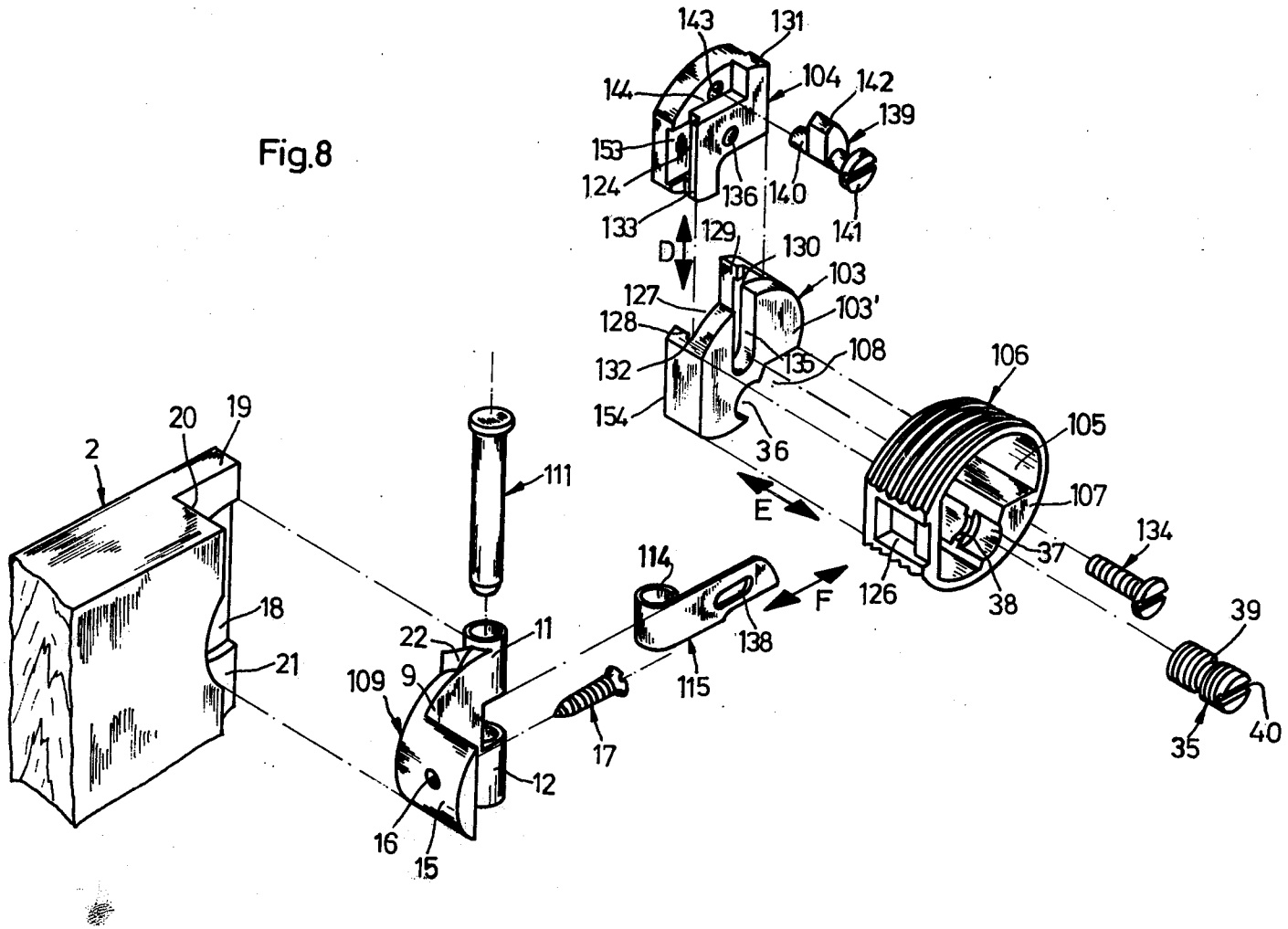
FIG. 8 is an exploded view in perspective of another embodiment of the hinge in accordance with the invention with the hinge parts separated, together with a partial view of a rabbetted cabinet door.
Figure 13:
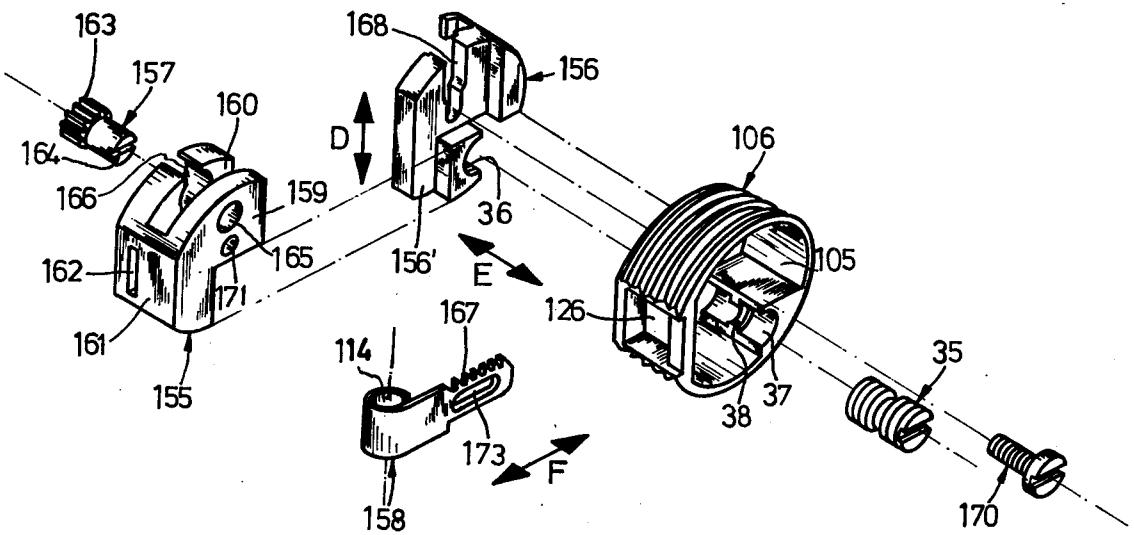
FIG. 13 shows in an exploded view in perspective a third embodiment of the hinge of the invention with the hinge parts separated from each other.
Figure 14:
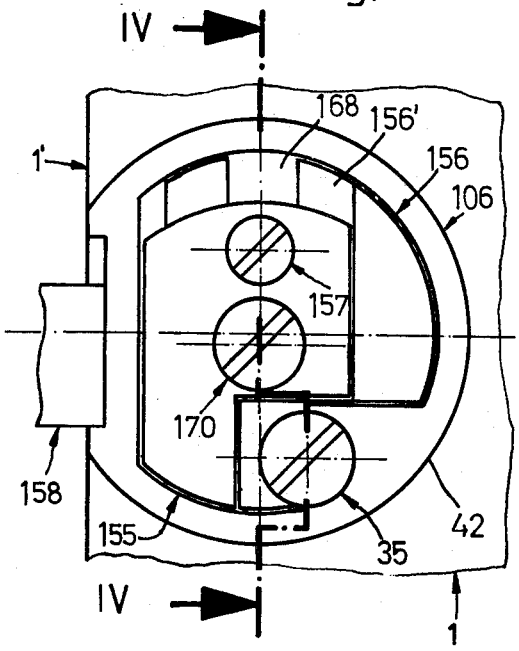
FIGS. 14 and 15 are a top view of the first hinge part in a section along the line IV—IV respectively in the case of the hinge shown in FIG. 13.
Figure 15:
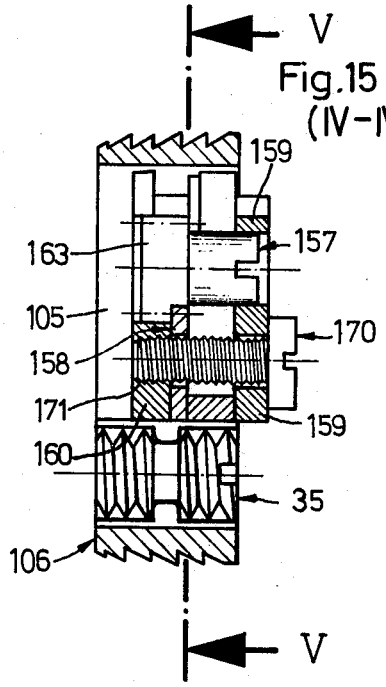
Figure 16:
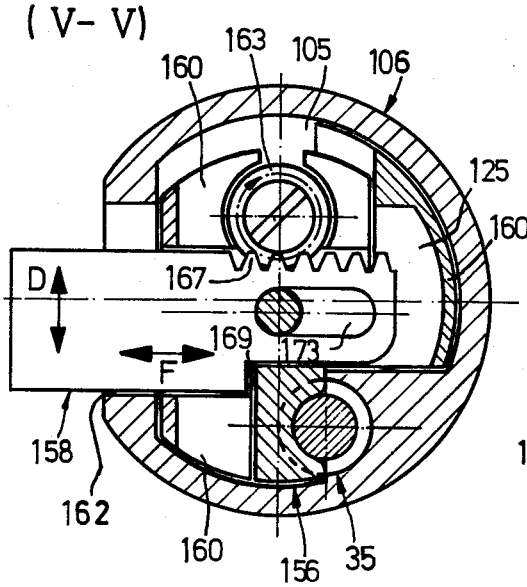
FIGS. 16 and 17 are a section along the line V—V through the first hinge part, with different positions of the hinge arm, in the longitudinal direction of the hinge arm in the case of the hinge in accordance with FIG. 13.
Figure 17:
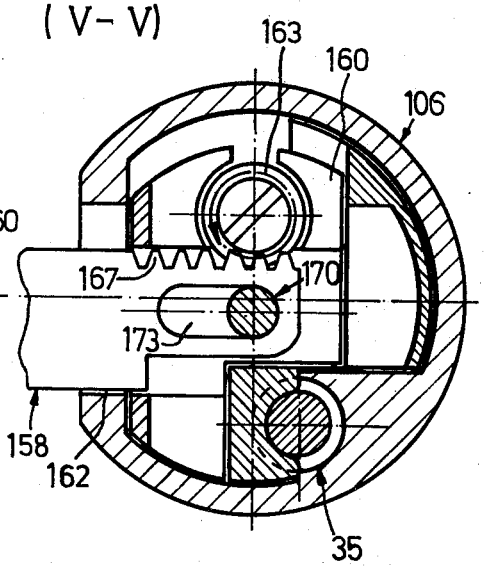

The depth and development of the recess 18 as well as the shape and thickness of the plate 9 are so selected that the surfaces of the plate 9 which are visible after the hinge part 8 has been fastened to the cabinet door 2 are flush with the surfaces 20 and 21 of the cabinet door 2 (see FIG. 2). The knuckles 11 and 12 for the hinge pin 10 lie, in this connection, in front of the front surface of the edge 19. Since the edge 19 as a rule is of very slight thickness so that it is not possible to screw a fastening screw into said edge perpendicular to the surface sides of the cabinet door 2, additional laterally protruding edge projections 22 are provided on the plate 9 in the vicinity of the knuckles 11 and 12 which projections, upon the turning of the fastening screw 17, press themselves laterally into the wall of the recess 18 or into the material of the edge 19 and thereby provide an additional anchoring of the hinge part 8 against the undesired tearing-out thereof.

For the connecting of the hinge arm 14 to the adjustment body 3 the latter has a recess or second opening 23 which extends parallel to the upper or inner surface of the cabinet body 1 and adapted, in the case of the embodiment shown, to the metal-strip material of the hinge arm 14, has a rectangular cross section. In the adjustment body there is furthermore provided a continuous borehole 24 extending perpendicular to the longitudinal axis of the recess 23 and which serves for supporting a cylindrical adjustment member 25. The borehole 24 is located in this connection essentially laterally of the recess or opening 23 on a longitudinal edge of the recess and intersects same slightly.

The adjustment member 25 is provided at one end with a toothing 26 and on the other end with a section 27 of reduced cross section of circular-cylinder shape and it is furthermore provided on this end with a slot 28 for a screwdriver, not shown. The central section 29 of the adjustment member 25, namely the section lying between the section 27 and the toothing 26, is also of a circular cylindrical cross section, the diameter of the central section 29 being equal to or somewhat greater than the maximum diameter of the toothing 26.

If the adjustment member 25 is pushed into the borehole 24 with the section 27 towards the front, then the toothing 26 extends into the opening 23 while the section 27 of the adjustment member 25 lies in a region of the borehole 24 which is of reduced cross section so that the adjustment member is prevented from falling in the direction of the arrow A of FIG. 1 out of the borehole 24.

The tang-shaped hinge arm 14 is provided on one longitudinal edge with a toothing 30 which, after the adjustment member 26 has been inserted into the borehole 24 and the hinge arm pushed into the opening 23, cooperates with the toothing 26 so that by turning the adjustment member 25 the tang-shaped hinge arm can be displaced via the toothings 26 and 30 within the opening 23 in the longitudinal direction of said opening. Since the diameter of the central section 29 is equal to or greater than the maximum diameter of the toothing 26, the adjustment member 25, after the introduction of the hinge arm 14 into the opening 23, rests via its central section 29 in the region of the transition between said section and the toothing 26 on the hinge arm 14 in the region of the toothing 30 so that, in this way, at the same time the adjustment member 25 is secured against falling out of the borehole 24 in the direction opposite that of the arrow A. The adjustment member 3 furthermore has a threaded borehole 31 for a screw 32, this threaded borehole opening into the recess 23, so that by screwing the screw 32 into the threaded borehole 31 the hinge arm 14 can be clamped fast in the recess 23. The screw 32 is provided with an extension or lengthening 33 of reduced cross section, this extension 33, after the screwing of the screw 32 into the threaded borehole 31 and before the hinge arm 14 has been clamped fast in the opening 23, extending through a slot 34 in the hinge arm, as a result of which the maximum displacement of the hinge arm 14 within the recess 23 is limited to the length of said slot 34 which extends in the longitudinal direction of the hinge arm 14, so that the undesired falling of the hinge arm 14 out of the recess 23 is prevented.

The adjustable displacement of the adjustment body 3 on the anchoring part 5 is effected by means of an adjustment screw 35 which is developed as a grub screw and lies in semicircular recesses 36 and 37 of the adjustment body 3 and the anchoring part 5 respectively. The semicircular recesses 36 and 37, which together form a closed circular recess, are provided in each case on one surface of the recess 7 of circular segment shape and the shoulder 6 of circular segment shape respectively, the recess 36 having a thread which cooperates with the thread of the adjustment screw 35. The recess 37 does not have a thread but does have, approximately in the center, a web 38 which extends transverse to the longitudinal axis of the recess and engages in an annular groove 39 approximately in the center of the adjustment screw 35 and holds said adjustment screw immovable in axial direction relative to the anchoring part 5. By turning the adjustment screw 35 which is provided for this purpose with a slot 40 at one end for a screwdriver, the adjustment body 3 can be pushed into the recess or opening 4 of the anchoring part 5, in order to compensate for manufacturing tolerances, perpendicular to the surface of the cabinet body 1. Since the thread of the adjustment screw 35 engages into the thread of the semicircular recess 36 and the web 38 at the same time lies in the annular groove 39, undesired displacement of the adjustment body 3 relative to the anchoring part 5 is not possible without turning the adjustment screw 35.

The assembling of the hinge parts is effected aproximately in the sequence that, first of all, the adjustment screw 35 is placed into the recess 37, and thereupon the adjustment body 3 is introduced, with rotation of the adjustment screw 35, into the opening 4 of the anchoring part 5. The adjustment member is now pushed into the borehole 24 in the direction indicated by the arrow A of FIG. 1, with the slot 28 at the front. Thereupon, the hinge arm 14 is pushed through a lateral opening 41 of the anchoring part 5 into the recess 23 of the adjustment body 3 until the toothing 26 of the adjustment member 25 comes into engagement with the toothing 30 of the hinge arm 14, as shown in FIG. 6. Further pushing of the hinge arm 14 into the opening 23 in the direction indicated by the arrow B of FIG. 6 is then effected by turning the setting member 35, i.e., in the case of the showing of FIG. 6, by turning the setting member in counterclockwise direction. As soon as the slot 34 of the hinge arm 14 is within the region of the threaded borehole 31, the screw 32 can be screwed into said threaded borehole so that the shoulder 33 of this screw engages into the slot 34 and the parts then have, for instance, the position with respect to each other which is shown in FIG. 6. By further turning the setting member 25 in counterclockwise direction, the hinge arm 14 is pulled completely into the recess 23, the end position being reached when the shoulder 33 lies against the other end of the slot 34, as shown in FIG. 7. By turning the setting member 25 in clockwise direction, the hinge arm 14 can be pushed back in the direction indicated by the arrow C into the position shown in FIG. 6.

The holding of the anchoring part 5 on the cabinet body 1 is effected in a borehole 42 on the inner surface of the cabinet body 1, the borehole 42 being at the same time also open towards the front surface 1' of the cabinet body 1 and the opening 41 of the anchoring part 5 remaining visible on said front surface 1'. The anchoring part 5 is provided for the anchoring thereof in the borehole 42 with circumferential ribs of barb-like action which embed themselves into the material of the cabinet body 1 and secure the anchoring part 5 against the undesired tearing thereof out of the borehole 42. It is, of course, also possible to anchor the anchoring parts 5 in some other manner, in the borehole 42 of the cabinet body 1, for instance by gluing, by special fastening screws, etc.

The hinge shown in FIGS. 1 to 7 permits a continuous displacement of the hinge arm 14 and thus also of the cabinet door 2 relative to the cabinet body 1 in two directions in space, namely in a direction perpendicular to the surface sides of the cabinet body 1 by means of the adjustment screw 35 and in the direction parallel to the surface sides of the cabinet body 1 by means of the adjustment member 25, the screw 32 being first of all slightly loosened for the latter adjustment so that its threaded end no longer rests firmly against the hinge arm, and then, after the adjustment, being again tightened and pressed against the hinge arm 14. For the stopping action of the hinge arm 14 produced by the screw 32 within the opening 23 it is advisable to provide the screw 32 at its threaded end with a frustoconically-shaped section which then passes into the shoulder 33 and by means of which the screw 32 after the tightening thereof rests firmly against the edge of the slot 34.

In the embodiment shown in FIGS. 8 to 12 for pivoting the rabbetted cabinet door 2 to the cabinet body 1, the hinge consists of a first hinge part which is formed from a base body 103 which forms the inner part of the first hinge part and a slide 104 held displaceably in the directiion of the double arrow D on the base body 103. The base body 103 is supported for adjustment or displacement together with the slide 104 in a second opening 105 of the anchoring part 106—in this case also of sleeve form—in the direction indicated by the double arrow E, i.e. in the direction perpendicular to the surface of the side wall 1 of the cabinet. The holding of the base body 103 in a non-turnable manner in the opening 105 of the anchoring part 106 is effected in the same way as has been described for the adjustment body 3 of FIGS. 1 to 7, namely with the aid of a shoulder 107 having the shape of a circular segment which extends into the opening 105 and engages into a segment-shaped recess 108 of the base body 103.

The hinge shown in FIGS. 8 to 12 furthermore consists of a second hinge part 109 which corresponds to the hinge part 8 of FIGS. 1 to 7 both with respect to its shape and with respect to its attachment to the cabinet door 2. On the hinge part 109, between the knuckles 11 and 12 of this hinge part a hinge arm 115 is pivoted by means of the pivot pin 111, said pivot pin 111 extending through the end 114 of said hinge arm which is rolled up to form a knuckle.

In order to hold the hinge arm 115 on the cabinet wall 1 a slot 124 is provided on the slide 104, said slot being adapted to the cross section of the tang-shaped hinge arm 115 and being of corresponding rectangular shape and extending in the direction indicated by the arrow F, i.e. in the direction parallel to the surface side of the cabinet wall and in the direction perpendicular to the double arrow D through the slide 104, and having an extension in a slot 125 of the base body 103. In the case of the cabinet door 2 fastened to the cabinet wall 1, the end of the hinge arm 115 which extends away from the pivot knuckle 114 thus passes through a recess 126 on the circumferential wall of the anchoring part 106 into the slide 104 and the base body 103 in such a manner that the hinge arm 115 is arranged in part within the slot 124 which forms the second opening of the first hinge part and in part within the slot 125, its surface sides being arranged parallel to the surface sides of the cabinet wall 1.

In order to be able to displace the slide 104 in the direction indicated by the double arrow D on the base body 103, a recess 127 which extends in the direction of the double arrow D is provided on a surface side of the base body 103, said recess 127 forming guide surfaces 128 and 129 for the slide 104, a groove 130 which forms an undercut surface being provided in the guide surface 129, and a lateral extension 131 of the slide 104 engaging into it. A similar groove 132 as well as a similar shoulder 133 are provided also on the guide surface 128 as well as on the side of the slide 104 associated with said guide surface. The slide 104 can be inserted laterally, i.e. in the direction indicated by the double arrow D, into the recess 127, the grooves 130 and 132 as well as the shoulders 131 and 133 being so developed that in addition to displacement of the slide in a direction indicated by the double arrow D a slight movement of the slide 104 in the direction indicated by the double arrow E relative to the base body 103 is also possible, i.e. the shoulders 131 and 132 have, for instance, a thickness which is slightly smaller than the width of the grooves 130 and 132.

For the fastening or locking of the slide 104 to the base body 103 and for the holding of the hinge arm 115 against the inner part of the first hinge part which consists of the slide 104 and the base body 103 there is provided a screw 134 which engages through a slot 135 which extends in the base body 103 in the direction of the double arrow D and through a borehole 136 in the slide 104 into a threaded borehole 137 also in the slide 104 which is aligned with the borehole 136. The borehole 136 as well as the threaded borehole 137 are located on opposite sides of the slot 124 so that the screw 134 in screwed condition passes through the slot 124 in the direction indicated by the double-armed arrow E and is passed through a slot 138 in the hinge arm 115.

In order to obtain as continuous as possible a displacement of the slide 104 relative to the base body 103, there is also provided, in the case of the hinge shown in FIGS. 8 to 12, a setting member 139 which consists essentially of a cylinder part 140 with head piece 141 formed thereon, the cylinder part 140 being provided approximately at its center with a cam body 142 whose peripheral surface in the circumferential direction of the cylinder part is at a varying distance from the center axis of said part. By its end which faces away from the head piece 141 the cylinder part extends into a supporting borehole 143 while the section of the cylinder part lying between the cam body 142 and the head piece 141 is guided in slot 135. The head piece 141 is accessible on the surface side of the base body facing away from the recess 127.

Depending on the rotary position of the adjustment member 139, the cam body 142 arranged in a recess 144 of the slide 104 extends to a greater or lesser extent over the circumferential surface of the slide so that upon the turning of the adjustment member 139 in the support borehole 143 by the cam body 142 which rests against the inner wall of the opening 105 there is obtained a displacement of the slide 104 relative to the anchoring part 106 as well as relative to the base body 104 which is guided in the recess 105 (FIGS. 11 and 12).

For the displacement of the inner part of the first hinge part which is formed of the base body 103 and the slide 104 within the opening 105 of the anchoring part 106 there is provided, in its turn, the adjustment screw 35 which engages into the semicircular recesses 36 and 37 of the base body 103 and of the anchoring part 106 respectively, the thread of the setting screw 35 cooperating with a thread in the recess 36 and the annular groove 39 of the adjustment screw 35 cooperating with the web 38 of the recess 37.

The assembling of the hinge parts is effected approximately in the sequence that first of all the adjustment member 139 with the cylinder part 140 is introduced into the supporting borehole 143 so that the cam body is located in the recess 144. Thereupon the slide which has been premounted in this manner with the adjustment member 139 is pushed from the side into the recess 127 so that the projections 131 and 133 engage into the grooves 130 and 132. Thereupon, the base body 103 is brought, by turning the adjustment screw 39, into the recess 105 of the anchoring part 106. In this condition, the anchoring part 106 can be anchored together with the base body 103 and the slide 104 in the borehole 42 of the cabinet wall 1 in the manner which has been described above in connection with FIGS. 1 to 7 for the anchoring part 5.

The fastening of the cabinet door 2, which has been premounted with the side hinge part 109 and the hinge arm 115, on the cabinet which has been premounted with the first hinge part (anchoring part 106, base body 103 and slide 104), is then effected in the manner that the free end of the hinge arm 115 is introduced in the manner described above through the recess 126 and the slot 124 into the slot 125. The screw 134 is now inserted through the slot 135, the borehole 136 and the slot 138 of the hinge arm 115 and screwed by means of its threaded end into the threaded borehole 137 of the slide 104, said threaded borehole 137 being located on that side of the inner part of the first hinge part formed by the slide 104 and base body 103 which (side) is no longer visible after the fastening of the anchoring part 106 in the borehole 42.

As soon as the threaded end of the screw 134 extends into the threaded borehole 137, the hinge arm 115 can no longer drop out of the base body 103 or the slide 104 so that one can start the aligning of the hinge arm 115 relative to the cabinet wall 1 in the three directions in space which are indicated by the double arrows D, E and F.

This alignment is effected, for instance, in the manner that, first of all, by turning the adjustment screw 35 the hinge arm 115 is brought into the correct position in the direction of the double arrow E. Thereupon the hinge arm 115 is adjusted along the axes A and F, for which purpose the slide 104 is moved by means of the adjustment member 139 relative to the base body 103 and the hinge arm 115 is pushed by hand within the slots 124 and 125 until it assumes the prescribed position. When this position has been reached, the screw 134 is tightened. Upon the tightening of this screw, the slide 104 moves slightly in the direction indicated by the arrow E towards the closed bottom of the recess 127, as a result of which the slot 124 is also pushed slightly in the direction of the double arrow E with respect to the gap 125 and the hinge arm 115 is clamped firmly in the two slots 124 and 125 in such a manner that the hinge arm 115 is pressed in the region of the slot 125 against the wall surfaces of the slot 125 which are adjacent the visible surface 103', and the part of the hinge arm 115 which lies in the slot 124 is pressed against the side surface of the slot 124 which is away from the visible surface side 103'. A similar clamping of the hinge arm 115 between slide 104 and base body 103 also takes place at the end of the slide 104 facing away from the slot 125 where said slot 124 opens into a groove 153 which is open towards the base body 103 and the depth of which is less than the thickness of the hinge arm 115 so that the part of the hinge arm lying in the region of the groove 153 is pressed, upon the tightening of the screw 134, against a surface 154 of the base body 103 which is adjacent the groove 153.

The embodiment of the hinge in accordance with the invention which is shown in FIGS. 8 to 12 has the advantage, in addition to possible displacement of the hinge arm 115 along all three coordinate axes D, E and F which are perpendicular to each other, that the locking of the slide 104 on the base body 103 and of the hinge arm 115 on the slide or base body is effected by means of a single screw 143.

FIGS. 13 to 19 shows an embodiment of the hinge of the invention which differs from the embodiment of FIGS. 8 to 12 essentially by the fact that an adjustment member for displacing the slide 155 in the direction of the double arrow D, i.e. in the direction of the hinge pivot pin relative to the base body 156 is omitted and instead of it there is provided in the slide 155 an adjustment member 157 by which a continuous sensitive displacement of the hinge arm 158 in the direction of the arrow F, i.e. in the lengthwise direction of the hinge arm relative to the base body 156, is possible. The base body 156 is held, together with the slide 155, in the same manner as the base body 103, in a recess 105 of the anchoring part 106 adjustable by means of the adjustment screw 35 in the direction perpendicular to the surface sides of the cabinet wall 1, i.e. in the direction corresponding to the part E and in the direction perpendicular to the arrow F.

The base body 156 is surrounded, at least in part, i.e. in its place-shaped part 156', on both sides of the slide 155 which for this purpose has two parallel wall sections 159 and 160 which lie parallel to the surface side of the cabinet wall 1 and are connected on one side by a transverse wall 161, this transverse wall extending in the direction of the double-arrow E and having a continuous slot 162 for the introduction of the hinge arm 158 and of the end of the hinge arm facing away from the hinge knuckle 114. The adjustment member 157 is provided on one end with a toothing 163 and on the other end with a slot 164 for a screwdriver (not shown) and is otherwise of circular cylindrical shape. For the supporting of the adjustment member 157 in the slide 155, bearing holes 165 and 166 are provided in the wall sections 159 and 160 of said slide, the bearing hole 165 in the wall section 159 serving to support the end of the adjustment member 157 which is provided with the slot 164 and the bearing hole 166 in the wall section 160 serving to support the end of the adjustment member 157 which is provided with the toothing 163.

On the one longitudinal edge of the hinge arm 158 there is provided a toothing 167 which cooperates with the toothing 163 of the adjustment member 157 for the continuous displacement of the hinge arm 158 in the direction indicated by the arrow F.

The assembling of the hinge is effected in the manner that first of all the adjustment member 157 is introduced, with the slot 164 towards the front, into the bearing holes 166 and 165. Thereupon, the slide 155 which is premounted in this manner with the adjustment member 157 is pushed from the side, i.e. in the case of the showing of FIG. 13 from the top, onto the base body 156 in such a manner that the plate-shaped part 156' comes to lie between the wall sections 159 and 160 of the slide 155 and the cylindrical part of the adjustment member 157 is located in a lengthwise recess 168 of the base body 156 which extends in the direction indicated by the double arrow D so that at the same time a guiding of the slide 155 on the base body 156 is obtained by the adjustment member 157 in the manner that the slide 155, while displaceable in the direction of the double arrow D is not displaceable in the direction of the double arrow F relative to the base body 156.

The base body, premounted with the slide 155, is then, after the insertion of the adjustment screw 35 into the recess 37, pushed by the turning of this adjustment screw into the opening 105 of the anchoring part 106. In this condition, the first hinge part is so fastened in the borehole 42 of the cabinet wall 1 that the slot 162 is accessible through the recess 126 of the anchoring part 106 from the front surface 1' of the cabinet wall 1. Now the hinge arm 158 can be introduced into the slot 162, which continues, in the region between the wall sections 159 and 160, in a laterally open groove 169 which, with the slide 155 pushed over the base body 156, is at least partially closed laterally by the surface side of the plate-shaped part 156' facing the wall section 160. After the engagement of the toothing 163 into the start of the toothing 167, the hinge arm is pulled into the slot 162 or the groove 169 by turning the adjustment member 157 (turning it in counterclockwise direction in the view seen in FIG. 13) so that the hinge arm 158 lies in part in the groove 169 between the wall section 160 and the surface side of the plate-shaped part 156' facing said wall section and in part also in the slot 162 and the end thereof provided with the hinge knuckle 114 protrudes from the recess 162 of the anchoring part 106. By the turning of a screw 170 into a threaded borehole 171 in the wall section 160, the hinge arm 158 is secured in the slide 155, the screw 170 passing through a borehole 162 in the wall section 159, through the lengthwise recess 168 and a slot 173 which extends in the direction of the axis or of the double arrow F. The screw 170 also serves at the same time to guide the slide 155 on the base body 156 and prevents a turning of the two parts with respect to each other. Since the toothing 163 extends into the groove 169 and thus is in engagement with the toothing 167 of the hinge arm 158, and hinge arm 158 can be displaced in the direction of the axis indicated by the double arrow F relative to the slide 155 and to the anchoring part 106 out of the position shown in FIG. 16 into the position shown in FIG. 17, and vice versa.

The adjusting of the hinge arm 158 along the three coordinate axes D, E and F, the axis D extending in the direction of the pivot axis of the hinge, the axis E perpendicular to the surface of the cabinet wall 1, and the axis F parallel to the surface of the cabinet wall 1 and at the same time perpendicular to the pivot axis of the hinge, is effected in the manner that first of all the base body 156 is adjusted, together with the slide 155, in the direction of the axis E by means of the adjustment screw 35. Thereupon the hinge arm 158 is possibly adjusted in the direction of the axis F by suitably turning the adjustment member 156. Then by displacing the slide 155 relative to the base body 156 the hinge arm 158 can be adjusted in the direction of the axis D. When the adjustment along the axes D and F has been concluded, the screw 170 is tightened, with the result that the head of this screw is pressed firmly against the surface side of the wall section 159, which surface side remains visible even after the insertion of the anchoring part 106 into the borehole 52 of the cabinet wall 1. The wall sections 159 and 160 are moved slightly towards each other as a result of the deformability of the material used for the slide 155, so that the part of the hinge arm 158 contained in the groove 169 is clamped fast between the wall section 160 and the surface side of the plate-shaped part 156' facing said wall section, which is possible in the manner than the depth of the groove 169 is selected somewhat smaller than the thickness of the hinge arm 158 or than the thickness of the wall-shaped material used for said hinge arm.

Figure 18:
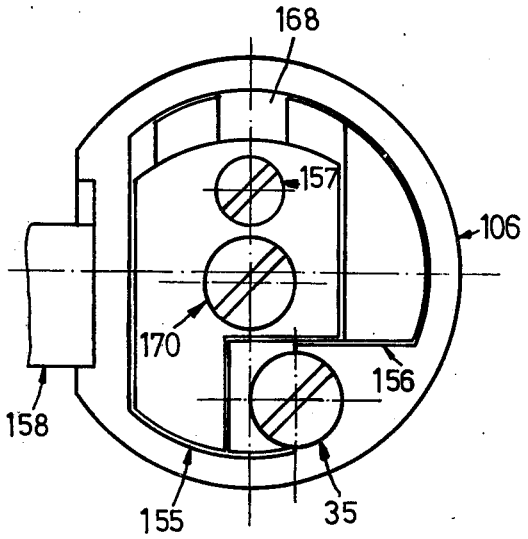
FIGS. 18 and 19 are a top view similar to FIG. 14 showing different positions of the hinge arm in the direction of the axis of swing of the hinge.
Figure 19:
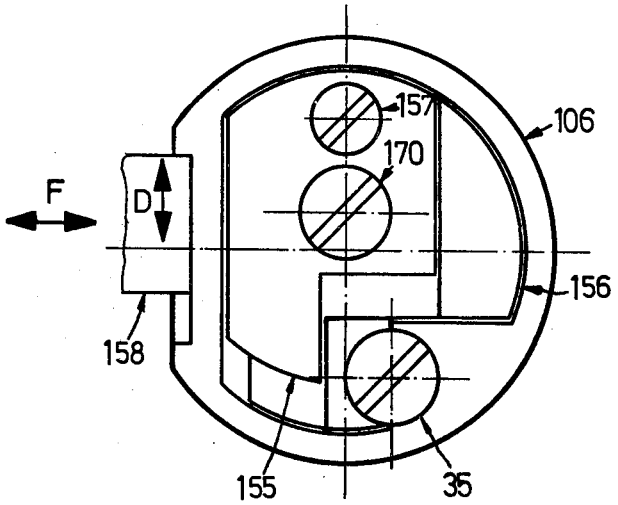

The embodiment shown in FIGS. 13–19 thus again the the advantage that by means of a single screw 170 both the hinge arm 158 is secured against undesired displacement in the direction of the double arrow F and a locking of the slide 155 on the base body 156 is obtained. FIGS. 18 and 19, similar to FIGS. 11 and 12, show the two possible extreme positions of the slide 155 with respect to the displacement in the direction of the double-arrow D.

The first hinge part consists of the anchoring part 5 or 106, of the adjustment body 3 or the base body 103 or 156 and the slide 104 or 155 is preferably made of metal. However, it is also possible to make this first hinge part or parts thereof of plastic. The same applies also to the second hinge part 8 or 109. The hinge arm 14 or 115 consists perferably of metal and is produced, for instance, from metal plate by stamping or bending.

The invention has been explained above with reference to illustrative embodiments. It is obvious that modifications thereof are possible without thereby going beyond the scope of the invention.

What is claimed is:

1. A hinge for articulated connection of two furniture components, said hinge comprising first and second hinge parts, said first hinge part comprising an outer anchoring sleeve operable to secure said first hinge part in a recess in a first of said components and an inner body disposed in said sleeve, and said second hinge part comprising means operable to secure said second hinge part to the second of said components and a pivotally mounted hinge arm, said outer sleeve of said first hinge part having a first opening operable to receive said inner body for selective positioning along a first axis which axis is perpendicular to the surface of said first component, means operable to position said inner body along said first axis and a second opening operable to permit communication of said hinge arm and said inner body along a second axis which axis is parallel to the surface of said first component, and said first hinge part inner body comprising a base and a slide, said inner body having means operable to receive said hinge arm for selective positioning along said second axis and means operable to position said hinge arm in said inner body along said second axis, said slide being displaceable relative to said base along a third axis perpendicular to both of said first and second axes.

2. A hinge according to claim 1 wherein at least a portion of said inner body hinge arm receiving means are disposed in said slide.

3. A hinge according to claim 2 wherein said inner body hinge arm receiving means includes a first slot extending in the direction of the second axis in said slide, and a second slot in said base.

4. A hinge according to claim 3 wherein said first slot on said slide and an adjoining wall section of said base extending parallel to said third axis define a recess in said inner body operable to receive said hinge arm.

5. A hinge according to claim 4 wherein said slide and said base have a slight play in the direction of said first axis sufficient upon convergence to clamp said hinge arm in said recess.

6. A hinge according to claim 5 wherein the dimension of said second slot in said body in the direction of the third axis is greater than that of the first slot in said slide.

7. A hinge according to claim 6 wherein said base is provided with a recess extending in the direction of said third axis and said slide is provided with lateral extensions operable to slide in said recess.

8. A hinge according to claim 7 wherein said recess is open at least at one end in the direction of said third axis for the introduction of said slide.

9. A hinge according to claim 8 including screw means operable to effect convergent clamping of said slide and said base.

10. A hinge according to claim 9 wherein the axis of said screw means is parallel to said first axis, said slide is provided with a threaded borehole receptive to engagement of said screw means, and said hinge arm is slotted along an axis parallel to said second axis, said screw means passing through said slot for engagement in said threaded borehole.

11. A hinge according to claim 1 including second adjustment means operable to displace said slide relative to said base in a direction parallel to said third axis.

12. A hinge according to claim 11 wherein said second adjustment means includes a cam body pivotally mounted on said slide and operating on either said base or said outer anchoring sleeve.

13. A hinge according to claim 1 wherein said slide has two parallelly extending spaced wall sections operable to receive and guide therein between a portion of said base.

14. A hinge according to claim 13 wherein said parallel wall sections of said slide are connected by a transverse wall, said slide thereby defining a fork shape, said transverse wall having a recess operable to receive said hinge arm.

15. A hinge according to claim 14 wherein said means operable to receive said hinge arm in said inner body is defined by said parallel wall sections of said slide and a surface side of of said body facing said transverse wall section.

16. A hinge according to claim 14 wherein said slide is sufficiently deformable to permit slight convergence of and clamping by said parallel wall sections against said base.

17. A hinge according to claim 16 wherein screw means are disposed on said slide, said screw means being operable to clamp said hinge arm in said inner body and to clamp said slide relative to said base by convergence of said parallel wall sections.

18. A hinge according to claim 17 wherein said base is provided with a recess running parallel to said third axis and said inner body hinge arm positioning means and said screw means on said slide pass through said recess, providing guide means for said slide on said base.

19. A hinge according to claim 1 wherein said inner body hinge arm positioning means are disposed on said slide.

20. A hinge according to claim 1 wherein at least said outer anchoring sleeve is metal or plastic.

21. A hinge according to claim 1 wherein said base and said slide of said inner body are metal or plastic.

* * * * *